United States Patent [19]

Self

[11] 3,990,580

[45] Nov. 9, 1976

[54] METHOD AND APPARATUS FOR SORTING SULTANAS

[75] Inventor: Roger Don Self, Stevenage, England

[73] Assignee: Gunson's Sortex Limited, London, England

[22] Filed: Jan. 22, 1975

[21] Appl. No.: 543,223

[30] Foreign Application Priority Data

Jan. 28, 1974 United Kingdom ..... 3851/74

[52] U.S. Cl. ..... 209/73; 209/111.5; 302/2 R; 302/17

[51] Int. Cl.[2] ..... B65G 53/02

[58] Field of Search ..... 209/73, 74, 75, 83, 209/111.5, 111.7, 111.6; 302/14, 2 R, 17, 29, 31

[56] References Cited

UNITED STATES PATENTS

| | | | |
|---|---|---|---|
| 2,615,567 | 10/1952 | Campbell | 209/73 |
| 2,799,540 | 7/1957 | Makinson | 302/14 |
| 2,835,373 | 5/1958 | Bickley | 209/73 X |
| 3,382,975 | 5/1968 | Hoover | 209/73 |
| 3,560,754 | 2/1971 | Kamentsky | 209/111.5 |
| 3,930,991 | 1/1976 | Gillespie | 209/111.6 X |

*Primary Examiner*—Robert B. Reeves
*Assistant Examiner*—Joseph J. Rolla
*Attorney, Agent, or Firm*—McGarry & Waters

[57] ABSTRACT

A sorting machine comprising a vertically inclined feed bed, a feeder for feeding objects to be sorted to an upper portion of said feed bed, the feed bed being adapted to be supplied with a fluid which fluidizes the objects thereon so that the latter flow to a lower portion of the feed bed, and a sorting arrangement which is arranged to receive the objects from the said lower portion and to separate them into groups of desired and undesired objects respectively.

17 Claims, 7 Drawing Figures

METHOD AND APPARATUS FOR SORTING SULTANAS

Figure 1:
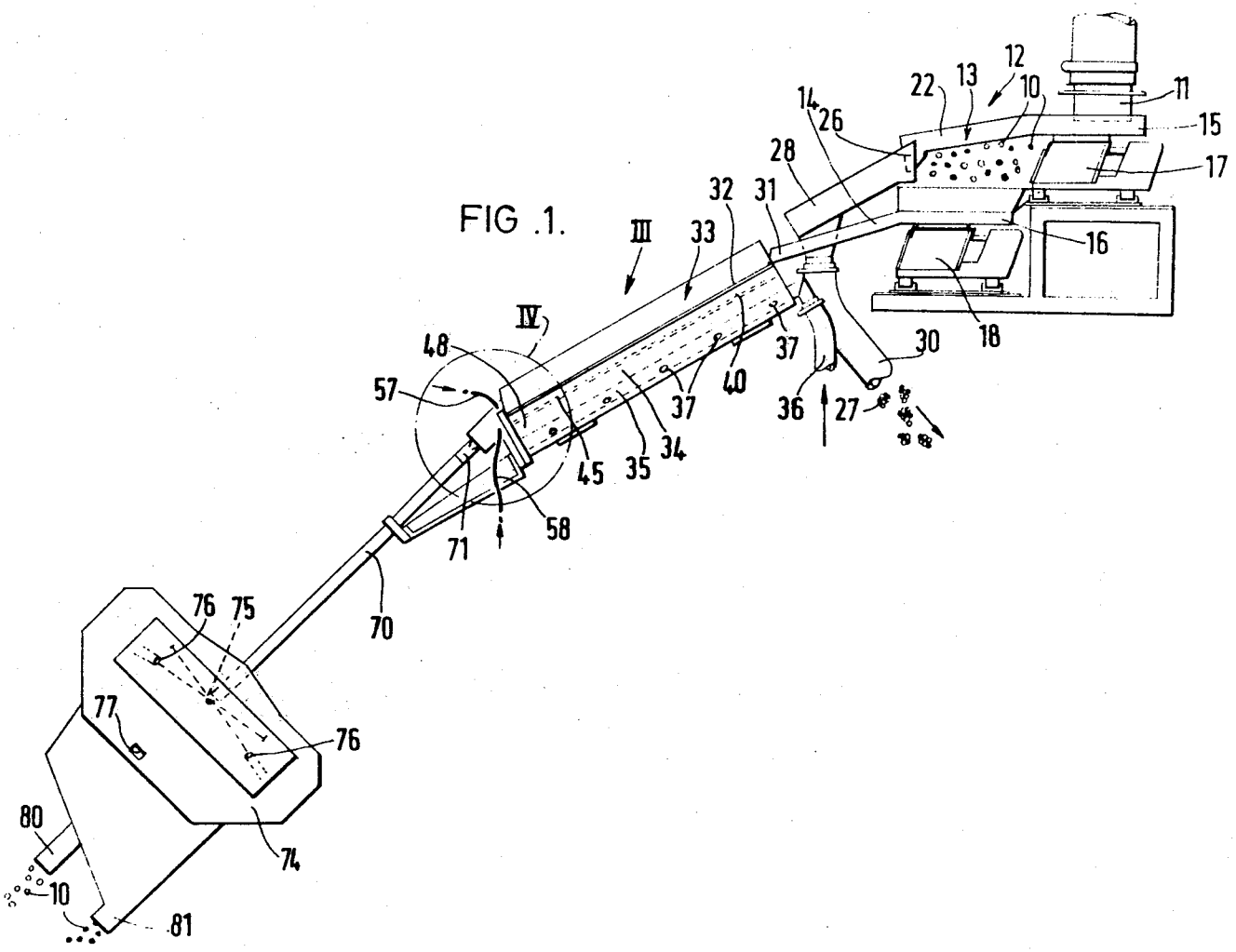

This invention concerns improvements in or relating to sorting desired from undesired objects, and, although the invention is not so restricted, it is more particularly concerned with the sorting of sticky objects such, for example, as sultanas.

Sultanas cannot be fed to a sorting machine successfully by conventional feeding means because, due to their sticky nature, they tend to agglomerate and to stick to the feeding means so that they cannot be presented one at a time, or in a regulated stream, to appropriate separator means.

According to the present invention, there is provided a sorting machine comprising a vertically inclined feed bed, feeding means for feeding a plurality of transversely aligned objects to be sorted to an upper portion of said feed bed, means for supplying the feed bed with a fluid which fluidises and singularizes the objects thereon so that the latter flow to a lower portion of the feed bed, substantially in single file and separator means which are arranged to receive the objects from the said lower portion and to separate them into groups of desired and undesired objects respectively.

The feed bed is preferably formed, and/or is provided with means, to urge the objects to leave the said lower portion substantially in single file.

Thus the feed bed may have side walls provided with apertures which are arranged to receive said fluid, the fluid which passes through said side wall apertures urging the objects to leave the said lower portion substantially in single file. Moreover, the width of the feed bed may decrease from its upper portion to its lower portion.

The machine is preferably provided with conduit means which are arranged to receive the objects from the said lower portion to convey them to the separator means, fluid jet means being provided for directing at least one fluid jet into said conduit means to accelerate the objects passing therethrough.

Means may be provided for supplying the fluid jet means with fluid at relatively high pressure.

The conduit means is preferably open to the ambient air so that the or each jet entrains ambient air therewith.

The fluid jet means is preferably adapted to cause the or each jet to pass into said conduit means in a direction substantially normal to the axis of the latter, the conduit means having a contoured internal wall over which the or each jet closely flows due to the Coanda effect.

The conduit means may comprise a transparent tube so that the passage of the objects therethrough can be viewed.

The feeding means preferably comprises means for removing therefrom objects, or agglomerations of objects, which are outside a predetermined size range, so that the latter objects, or agglomerations of objects, are not supplied to the said upper portion of the feed bed.

Thus the feeding means may comprise an upper feed tray which is mounted above a lower feed tray and which is provided with an aperture or apertures through which may pass only those objects which are within the said predetermined size range, the upper feed tray having an outlet end which communicates with at least one rejection duct, and the lower feed tray having an outlet end which communicates with the feed bed, means being provided for vibrating each feed tray so as to cause the objects to pass thereover towards the respective outlet end.

The separator means may comprise optical viewing means for viewing each object, and ejector means, controlled by said optical viewing means, for removing objects.

The invention also comprises a method of sorting comprising feeding a plurality of transversely aligned objects to be sorted to an upper portion of a feed bed, supplying the feed bed with a fluid which fluidises and singularizes the objects thereon so that the latter flow to a lower portion of the feed bed, substantially in a single file and separating the objects which have left the said lower portion into groups of desired and undesired objects respectively.

The said objects may be sticky and, in this case, it may be arranged that only single objects are fed to the feed bed, agglomerations of objects being removed.

The objects which have left the said lower portion are preferably passed into conduit means through which they are accelerated by at least one fluid jet which increases the spacing between the objects. The length of the conduit means is preferably such that substantially all the objects leave the downstream end of the conduit means axially thereof and substantially evenly spaced apart.

Figure 2:
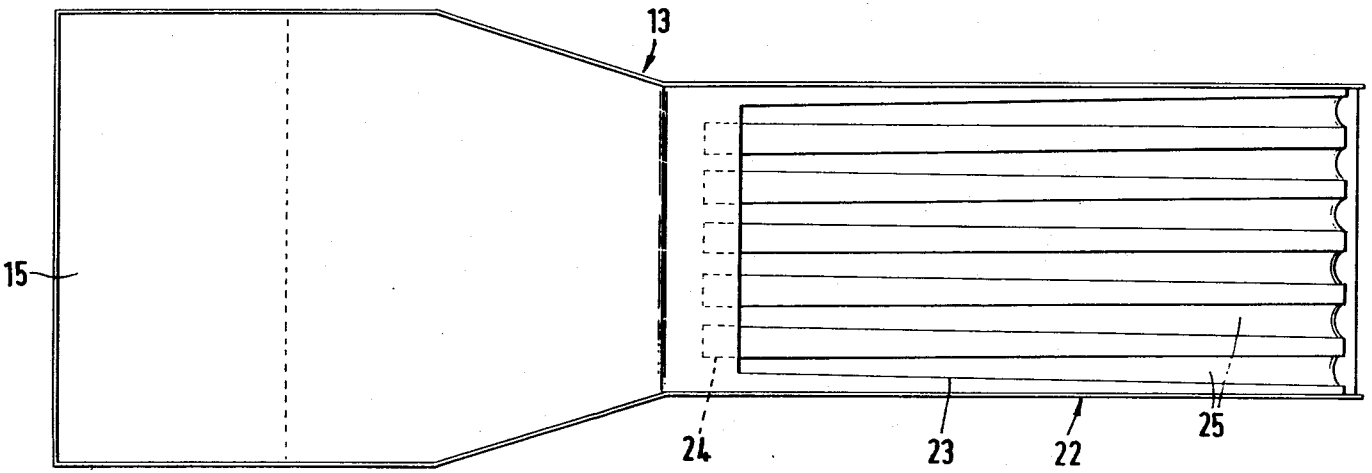
Figure 3:
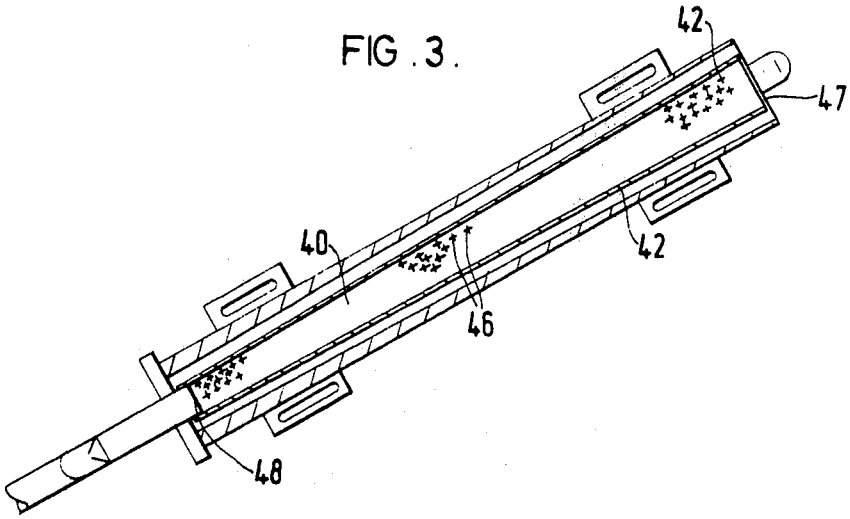
Figure 4:
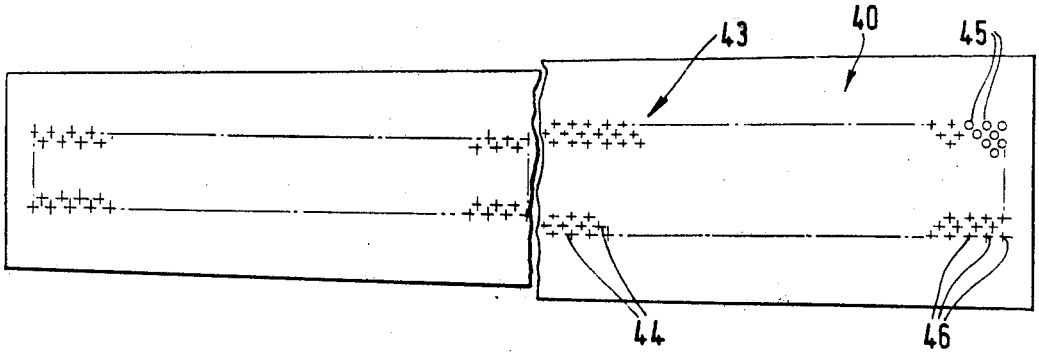
Figure 5:
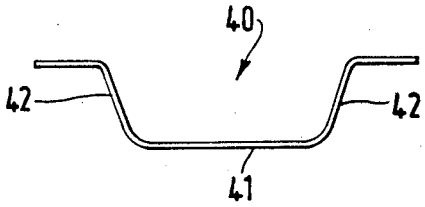
Figure 6:
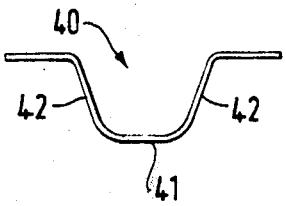
Figure 7:
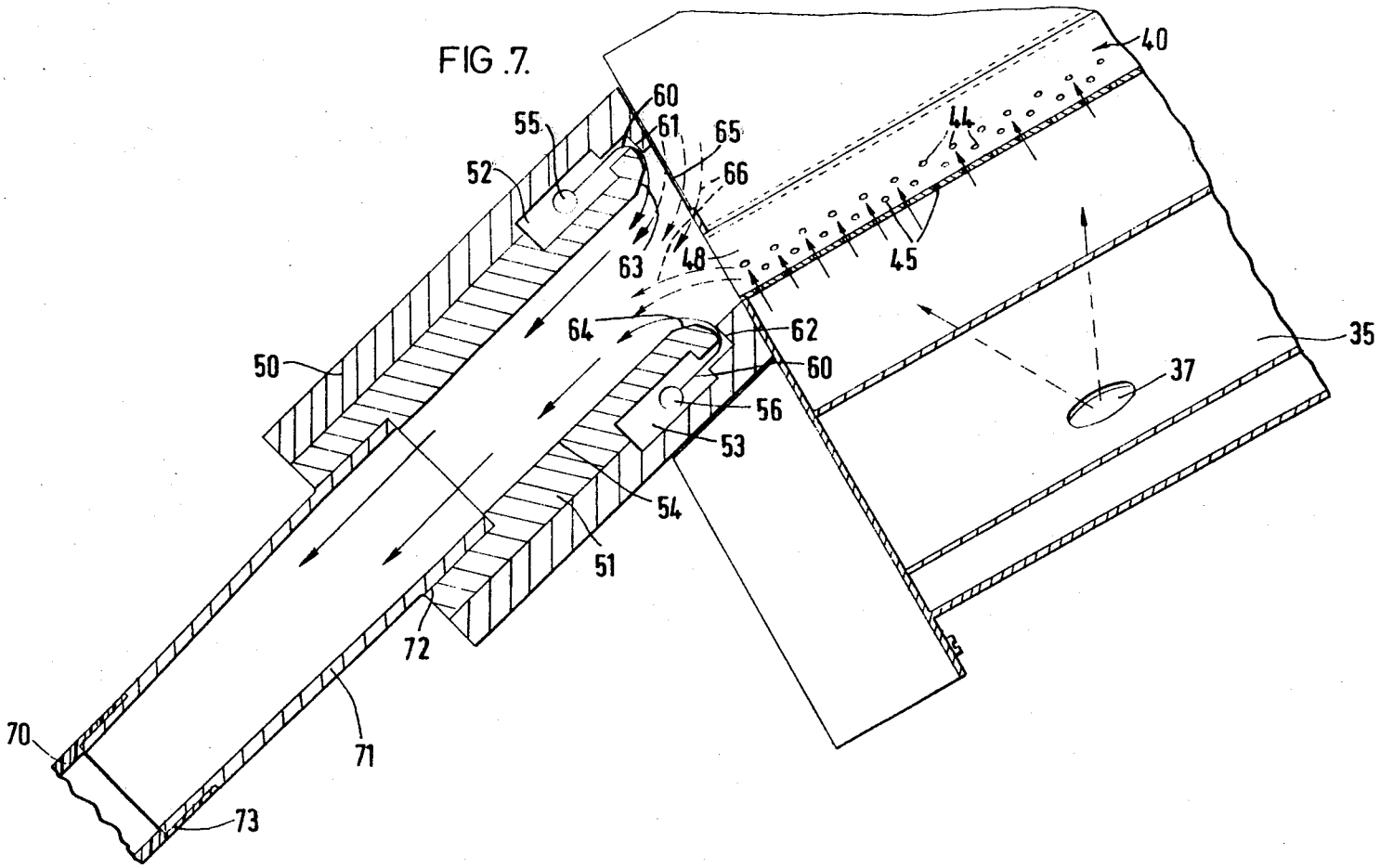

The invention is illustrated, merely by way of example, in the accompanying drawings, in which:

FIG. 1 is a side elevation of a sorting machine according to the present invention, FIG. 2 is a plan view of an upper feed tray which forms part of the sorting machine of FIG. 1, FIG. 3 is a broken-away plan view of a part of the sorting machine of FIG. 1 looking in the direction of the arrow III thereof, FIG. 4 is a developed plan view of a feed bed tray which forms part of the structure shown in FIG. 3, FIGS. 5 and 6 are end views of the feed bed tray of FIG. 4 showing the upper and lower end portions thereof respectively, and FIG. 7 is a broken-away vertical sectional view showing the structure within the circle IV of FIG. 1 on a larger scale.

In FIG. 1 there is shown a sorting machine comprising a hopper (not shown) which is adapted to be supplied with a quantity of sultanas 10 (or other sticky objects) to be sorted. The hopper is provided with an outlet duct whose lowermost portion 11 is rotatable with respect to the remainder thereof so that the sultanas 10 may be dispensed successively to each of six (or any other desired number) of adjacent longitudinally aligned sorting channels 12. Only one channel 12 is shown in the drawings and, for ease of explanation, only one channel 12 will be referred to below.

The sorting channel 12 comprises an upper feed tray 13 which is mounted above a lower feed tray 14. The feed trays 13, 14 respectively have end portions 15, 16 which are respectively mounted on electro-magnetic or other vibrators 17, 18. The vibrators 17, 18 are arranged to effect horizontal vibrator movement of the feed trays 13, 14 so that sultanas 10 fed thereto are moved towards the left as seen in FIG. 1.

The upper feed tray 13 has a downwardly sloping outlet end portion 22 which is cut away to provide a longitudinally extending hole 23 (FIG. 2). A plurality of longitudinally extending fingers 24 are secured to the underside of the upper feed tray 13 and extend throughout the length of the hole 23 so as to define between themselves a plurality of longitudinally extending apertures 25. The upper feed tray 13 is also provided at its lowermost end with a chute portion 26 (see FIG. 1).

The size of single sultanas 10 is such that they pass through the apertures 25 so as to fall onto the lower feed tray 14, whereas agglomerations 27, of sultanas 10 which have become stuck together and which are therefore oversize, are unable to pass through the longitudinal apertures 25 and therefore pass via the chute portion 26 to a collection tray 28. The agglomerations 27 then pass from the collection tray 28 to one of a plurality of rejection ducts 30 (only one shown).

The lower feed tray 14 has a converging downwardly sloping outlet end portion 31 the vibration of which accelerates the sultanas 10 towards an upper end portion 32 of a vertically inclined feed bed 33 at a controlled rate.

The feed bed 33 (which may be inclined at an angle of 30° to the horizontal) comprises a housing 34 in the lower portion of which there is mounted an air manifold 35. The air manifold 35, which is supplied with air from a source (not shown) by way of an inlet pipe 36, has a plurality of longitudinally spaced apertures 37 therein through which the compressed air passes to the interior of the housing 34. The air supplied to the inlet pipe 36 is low pressure air, e.g. at a pressure of 1 lb per square inch gauge.

Mounted in the housing 34 above the air manifold 35 is a feed bed tray 40. The feed bed tray 40 is channel-shaped having a flat bottom 41 and outwardly sloping side walls 42. The feed bed tray 40 is formed from a sheet of aluminium alloy which is initially drilled, throughout a region 43, with a plurality of rows 44 of apertures 45 (see FIG. 7), the centres of which are indicated at 46. As indicated in FIG. 4, the centres 46 of the apertures 45 of each row thereof are staggered with respect to those of the adjacent rows.

When the feed bed tray 40 has been so drilled, it is then bent to the shape indicated in FIGS. 5 and 6, with the result that the apertures 45 will be provided not only throughout the bottom 41 of the feed bed tray 40 but also in the lower portions of the side walls 42. As will be seen by comparing FIGS. 5 and 6, the width of the feed bed tray 40 decreases from its upper end 47 to its lower end 48.

Low pressure air from the air manifold 35 passes out through the apertures 37 therein and then passes from the interior of the housing 34 through the hundreds of apertures 45 in the bottom 41 and in the side walls 42 of the feed bed tray 40. Accordingly hundreds of tiny air jets are provided which fluidise the sultanas 10 so that they accelerate, under gravity, to the lower end portion 48 of the feed bed tray 40. The air jets in the bottom of the feed bed tray 40 keep the sultanas 10 floating immediately above the surface of the feed bed tray 40 with the result that the build-up of sticky juices on the feed bed tray 40 is reduced, while the coefficient of friction between the sultanas 10 and the feed bed tray 40 is reduced almost to zero. The converging side walls 42 of the feed bed tray 42, in conjunction with the air jets issuing through the apertures 45 in the side walls 42, helps to align and separate the sultanas 10 into, very approximately, a single file line of sultanas.

Secured to the lower end of the housing 34 is a rectangular conduit member comprising an outer conduit member 50 within which is mounted an inner conduit member 51 (see FIG. 7). The inner conduit member 51 is axially slidable in the outer conduit member 50 to a limited axial extent and may be secured (by means not shown) in a fixed axial position. The outer and inner conduit members 50, 51 are respectively provided with cut-out portions which cooperate with each other to define rectangular cavities 52, 53 which are disposed diametrically oppositely of the internal substantially rectangular wall 54 of the inner conduit member 51. The cavities 52, 53 are respectively provided with air inlets 55, 56 which respectively communicate with air tubes 57, 58 (see FIG. 1). The air tubes 57, 58 are supplied, from a source (not shown) of high pressure air, the air being, for example, at a pressure of 40 lbs per square inch gauge.

As indicated by the full line arrows 60, the high pressure air from the air inlets 55, 56 passes out of the cavities 52, 53 through rectangular outlet portions 61, 62 thereof which constitute jet nozzles. The jet nozzles 61, 62 direct the high pressure air in a direction substantially normal to the axis of the inner conduit member 51. The jet nozzles 61, 62 may have a width of 0.003 inches, although by reason of the adjustability of the inner conduit member 51 within the outer conduit member 50, the width of the jet nozzles 61, 62 may if desired be increased up to 0.010 inch.

The internal wall 54 has contoured portions 63, 64 over which the jets emerging from the jet nozzles 61, 62 closely flow due to the Coanda effect. Thus, the said jets 61, 62 attach themselves to the contoured portions 63, 64 and are thus turned through a right angle so that they finally pass axially downwardly through the interior of the inner conduit member 51.

The jets from the jet nozzles 61, 62 on being bent through a right angle, expand so as to exercise a mild suction both on the fluidised sultanas 10 which are passing through the feed bed tray 40 and also on ambient air to which the interior of the inner conduit member 51 is open by way of its open upper end 65. Large quantities of ambient air are therefore entrained into the interior of the inner conduit member 51 as indicated by the dotted arrows 66. As a result, the total volume of air passing through the inner conduit member 51 is substantially increased, and the sultanas 10 from the lower end portion 48 of the feed be tray 40, where they are substantially in single file, are acted on by the said jets so as to be accelerated through the interior of the inner conduit member 51. Thus, as the sultanas 10 float off lower portion 48 of the feed bed tray 40 into the interior of the inner conduit member 51, the sultanas are aligned one behind the other, and come under the influence of the air jets from the jet nozzles 61, 62 at slightly different times, with the result that a physical separation between the sultanas is produced.

The inner conduit member 51 is connected to an inclined transparent conduit 70 by way of a connector conduit 71. The upper end of the connector conduit 71 is formed to be seated in a square recess 72 in the inner conduit member 51, while the lower end of the connector conduit is formed to be received in a circular recess 73 in the transparent conduit 70. The conduit 70, which may be inclined at an angle of 45° to the horizontal, and which may for example be made of the material sold under the Registered Trade Mark "Perspex", is transparent so that the sultanas 10 passing therethrough can be viewed to ensure that a desired feed has been obtained. Since the agglomerations 27 of sultanas are removed at an early stage by the provision of the upper feed tray 13 with its apertures 25, these agglomerations are prevented from jamming the feed, only single sultanas being fed to the feed bed tray 40.

The sultanas which pass through the transparent conduit 70 pass to the interior of an optical box 74. The length of the transparent conduit 70 is such that by the time that the sultanas 10 reach the downstream end of the transparent conduit 70 they are travelling truly axially thereof and are substantially evenly spaced apart. Accordingly the sultanas 10 are presented sequentially to a viewing region 75 which is spaced about one sixteenth of an inch from the downstream end of the transparent conduit 70. Viewing is not effected through the transparent conduit 70 itself since the latter can become obscured by a build up of dirt therein, although it is possible, if desired, to effect viewing through the wall of the transparent conduit 70 itself provided that the latter is continuously washed with a washing liquid.

The viewing of the sultanas in the viewing region 75 is effected by a plurality of optical light sensors 76, e.g. photocells, which produce signals which are fed to a comparator (not shown), where they are compared with a datum signal. Thus, when a discoloured sultana passes through the viewing region 75, the signals sent by the light sensors 76 to the comparator are such that the comparator produces an output signal which causes a pneumatic ejector 77 to direct a jet of compressed air onto the discloured sultana. Sultanas which have a desired colour pass to an "accept" chute 80 while those which have an undesired colour are ejected by the ejector 77 so as to pass to a "reject" chute 81.

Although in the specific embodiment described above the separation of the sultanas into groups of desired and undesired sultanas is effected by means of the optical light sensors 76 and ejector means 77 controlled thereby, the separation of the desired from the undesired sultanas may be effected by any desired means. Moreover, of course, the present invention is not restricted to the sorting of sultanas so that the separator with which the transparent tube 70 communicates may be constituted by a size sorter, a conductivity sorter, an X-ray sorter or sorters which work on other physical parameters.

I claim:

1. A sorting machine comprising a vertically inclined feed bed, feeding means for feeding a plurality of transversely aligned objects to be sorted to an upper portion of said feed bed, means for supplying the feed bed with a fluid which fluidises and singularizes the objects thereon so that the latter flow to a lower portion of the feed bed substantially in single file, and separator means which are arranged to receive the objects from the said lower portion and to separate them into groups of desired and undesired objects respectively.

2. A sorting machine as claimed in claim 1 in which the width of the feed bed decreases from its upper portion to its lower portion.

3. A sorting machine as claimed in claim 1 in which the separator means comprises optical viewing means for viewing each object, and ejector means, controlled by said optical viewing means, for removing undesired objects.

4. A sorting machine as claimed in claim 1 in which the feed bed also urges the objects to leave the said lower portion substantially in a single file.

5. A sorting machine as claimed in claim 4 in which the feed bed has side walls provided with apertures which are arranged to receive said fluid, the fluid which passes through said side wall apertures urging the objects to leave the said lower portion substantially in single file.

6. A sorting machine as claimed in claim 1 comprising conduit means arranged to receive the objects from the said lower portion to convey them to the separator means, fluid jet means being provided for directing at least one fluid jet into said conduit means to accelerate the objects passing therethrough.

7. A sorting machine as claimed in claim 6 in which means are provided for supplying the feed bed with fluid at relatively low pressure, and for supplying the fluid jet means with fluid at relatively high pressure.

8. A sorting machine as claimed in claim 6 in which the conduit means is open to the ambient air so that the jet entrains ambient air therewith.

9. A sorting machine as claimed in claim 6 in which the fluid jet means is adapted to cause the jet to pass into said conduit means in a direction substantially normal to the axis of the latter, the conduit means having a contoured internal wall over which the jet closely flows due to the Coanda effect.

10. A sorting machine as claimed in claim 6 in which the conduit means comprises a transparent conduit so that the passage of the objects therethrough can be viewed by an operator.

11. A sorting machine as claimed in claim 1 in which the feeding means comprise means for removing therefrom objects, and agglomerations of objects, which are outside a predetermined size range, so that the latter objects, and agglomeration of objects, are prevented from being supplied to the said upper portion of the feed bed.

12. A sorting machine as claimed in claim 11 in which the feeding means comprises an upper feed tray which is mounted above a lower feed tray and which is provided with at least one aperture through which may pass only those objects which are within the said predetermined size range, the upper feed tray having an outlet end which communicates with at least one rejection duct, and the lower feed tray having an outlet end which communicates with the feed bed, means being provided for vibrating each feed tray so as to cause the objects to pass thereover towards the respective outlet end.

13. A method of sorting comprising feeding a plurality of transversely aligned objects to be sorted to an upper portion of a feed bed, supplying the feed bed with a fluid which fluidises and singularizes the objects thereon so that the latter flow to a lower portion of the feed bed substantially in a single file, and separating the objects which have left the said feed bed lower portion into groups of desired and undesired objects respectively.

14. A method as claimed in claim 13 in which the objects are sticky.

15. A method as claimed in claim 14 in which single objects only are fed to the feed bed, agglomerations of objects being removed.

16. A method as claimed in claim 13 in which the objects which have left the said lower portion are passed into conduit means through which they are accelerated by at least one fluid jet which increases the spacing between the objects.

17. A method as claimed in claim 16 in which the length of the conduit means is such that substantially all the objects leave the downstream end of the conduit means axially thereof and substantially evenly spaced apart.

* * * * *